United States Patent [19]

Koppehele et al.

[11] 4,361,285

[45] Nov. 30, 1982

[54] MIXING NOZZLE

[75] Inventors: Hugh P. Koppehele, Fairfield; James J. Gardner, Hamilton, both of Ohio

[73] Assignee: Fluid Kinetics, Inc., Fairfield, Ohio

[21] Appl. No.: 156,222

[22] Filed: Jun. 3, 1980

[51] Int. Cl.[3] ..... B05B 7/06

[52] U.S. Cl. ..... 239/424; 239/524

[58] Field of Search ..... 239/416, 404, 420, 424, 239/102, 524, 422, 423, 426, 427.3, 427.5

[56] References Cited

U.S. PATENT DOCUMENTS

| | | | |
|---|---|---|---|
| 3,245,622 | 4/1966 | McBride | 239/425 |
| 3,297,255 | 1/1967 | Fortman | 239/102 |
| 3,389,861 | 6/1968 | Nakanishi et al. | 239/422 |
| 3,464,633 | 9/1969 | Potocnik | 239/425 |
| 3,520,480 | 7/1970 | Halvorsen | 239/404 |
| 3,533,558 | 10/1970 | Masters | 239/404 X |
| 3,638,865 | 2/1972 | McEneny et al. | 239/404 X |
| 3,662,547 | 5/1972 | Paine et al. | 239/424 X |
| 3,702,175 | 11/1972 | Watkins et al. | 239/422 |
| 3,717,306 | 2/1973 | Hushon et al. | 239/404 |
| 3,719,325 | 3/1973 | Cerva et al. | 239/405 |
| 3,735,778 | 5/1973 | Garnier | 239/420 X |
| 3,741,484 | 6/1973 | Cresswell | 239/424 |
| 3,758,258 | 9/1973 | Kolhi | 239/291 X |
| 3,779,460 | 12/1973 | Monroe | 239/102 |
| 3,852,022 | 12/1974 | Medeot et al. | 239/420 X |
| 3,923,248 | 12/1975 | Cresswell | 239/113 |
| 3,980,233 | 9/1976 | Simmons et al. | 239/400 |
| 4,004,733 | 1/1977 | Law | 239/424 X |
| 4,018,387 | 4/1977 | Erb et al. | 239/405 |

FOREIGN PATENT DOCUMENTS

| | | | |
|---|---|---|---|
| 1475771 | 6/1977 | United Kingdom | 239/422 X |
| 1545284 | 5/1979 | United Kingdom | 239/422 X |
| 1549957 | 8/1979 | United Kingdom | 239/422 X |

*Primary Examiner*—Andres Kashnikow
*Assistant Examiner*—Gene A. Church
*Attorney, Agent, or Firm*—Biebel, French & Nauman

[57] ABSTRACT

A mixing and atomizing nozzle is disclosed which has a first or inner orifice which directs a thin film of gas outwardly and expands the same to supersonic speed for subsequent transition to subsonic speed over a deflector member or mandrel, together with first and second orifices which are positioned adjacent each other and immediately outwardly of the first orifice for applying thin films of first and second liquids for mixing and atomization.

3 Claims, 2 Drawing Figures

MIXING NOZZLE

BACKGROUND OF THE INVENTION

This invention relates to atomizing spray nozzles and more particularly to a nozzle which uses air or other gas under pressure for liquid atomization at a supersonic-subsonic transition region, together with means for applying two or more liquid phases to be intimately atomized, dispersed and intermixed with each other.

There is a need for nozzles which have the capability or function of mixing two-part or multi-part liquid materials at a region outside of the nozzle, so that the materials, which may be reactive or which may interact with each other, may be delivered and metered independently and separately to the exit regions or orifices of the nozzle for the purpose of mixing and atomization. Such a nozzle should mix two-part materials without the use of a separate dynamic or in-line motionless mixer. The present invention is an improvement applied to the nozzles described and claimed in the U.S. Pat. Nos. of Cresswell, 3,741,484 issued June 26, 1973 and 3,923,248 issued Dec. 2, 1975. In the Cresswell patent disclosures, which are incorporated herein by reference, air or gas atomizing nozzles have a single outer annular ring or layer of liquid applied to a deflector or distributor and broken up by an inner layer of gas expanded to a supersonic velocity over the outer surface of the deflector. The acoustic shock wave created at the sonic transition further causes a break up of the particles.

SUMMARY OF THE INVENTION

It has been found that a spray nozzle constructed according to the teachings of the Cresswell patents can be made such that a second liquid phase is delivered in immediate superimposed relation to the first phase, and these two separate liquid phases, which may be miscible or immiscible, are caused to be intimately mixed with each other and reduced in particle size by the shock wave at the transition region between supersonic and subsonic flow. As an example, the nozzle of this present invention may be used for effectively mixing two-part paints in which each of the paint parts are accurately metered and presented at the nozzle orifice. It may also be used to intermix and atomize generally immiscible materials, such as an oil burner nozzle for mixing number two fuel oil as the first phase and a mixture of waste products such as styrene, ethylbenzene, and water, as the second phase. Further examples include the mixing of two-part urethane foams, mixing emulsifying oil and asphaltic compounds continuously such as for spraying adobe buildings for waterproofing purposes, adding small amounts of waters or the like to oil components for burning for the purpose of reducing pollutants, nitrides and the like, and burning waste products, such as water filled crudes, bacterial sludges, etc., in which raw fuel is added to the waste material at the nozzle for atomization and burning.

It is accordingly an important object of this provision to provide a sonic type mixing nozzle in which two or more liquid phases may be metered and mixed exteriorly of the nozzle with the gas phase, which liquid phases may be either miscible or immiscible.

A still further object of the invention is to provide a mixing nozzle which may be used for burning fuels or disposing of undesirable contaminants or the like which would not otherwise be burnable, by the addition to a solvent or raw fuel to the undesirable material and mixing the same using gas or stream pressure.

A still further object of the invention is the provision of a multiple-part nozzle, having a wide variety of uses, such as for mixing two-part paints or two or more other liquid materials employing gas under pressure, such as air pressure or steam pressure, causing the air to flow axially outwardly through the nozzle and expanding to accelerate through the supersonic range while shearing and transporting the two materials to be mixed by applying separately the two films of liquid materials to the inner sheath of the gas as it exits the nozzle.

These and other objects and advantages of the invention will be apparent from the following description, the accompanying drawings and the appended claims.

DESCRIPTION OF THE PREFERRED EMBODIMENT

Figure 1:
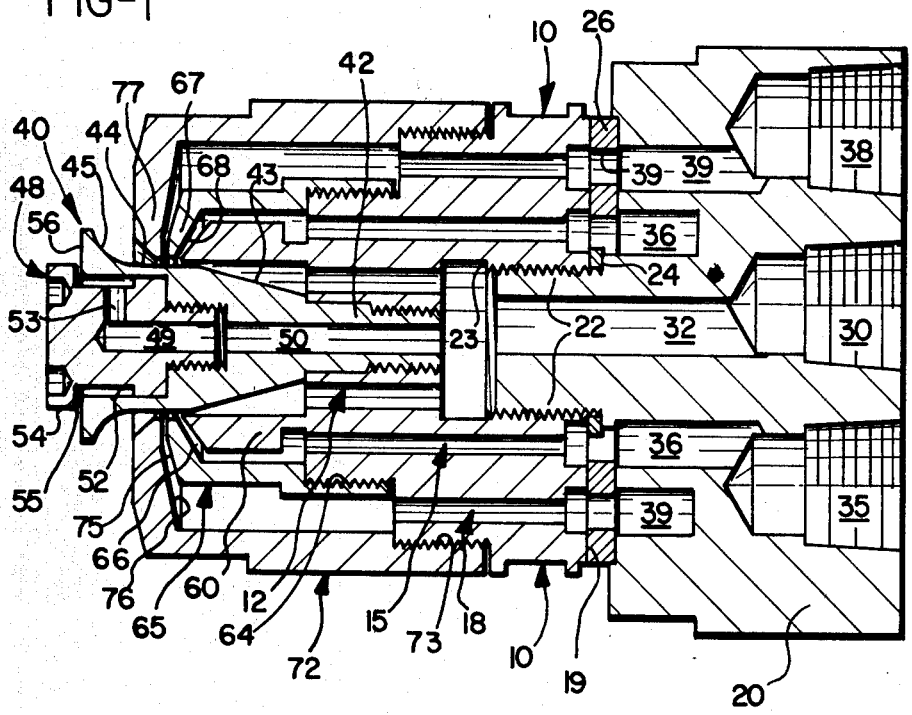
FIG. 1 is a sectional view through a nozzle made according to this invention.

Referring to FIG. 1 which is a longitudinal cross-sectional view through a nozzle constructed according to this invention, an cylindrical main nozzle block or body is illustrated generally at 10. The body 10 includes three annular sets or groups of passageways which extend axially through the body. The first or inner set of passageways is illustrated generally at 12 and provide for the passage of air or other gas under pressure. While two of the passageways 12 are shown, it is understood that passageways 12 are part of an annular or array or plurality of circumferentially spaced passageways.

The body 10 includes an intermediate or second annular group or array of axially aligned passageways 15 for conducting a first fluid phase therethrough. Again, while only two of the passageways 15 are shown, it is understood that the body 10 includes a plurality of circumferentially spaced passageways 15 arranged in a circle when viewed from an end of the body 10.

The body 10 further includes a third and outer annular group or array of axially aligned passageways 18 for conducting a second fluid phase therethrough. Again, as in the case of the passageways 12 and 15, only two of the passageways 18 are shown, and it is understood that the body 10 includes a plurality of circumferentially spaced, axial passageways 18 therethrough.

The rear face 19 of the body 10 is flat and receives an adapter 20 thereon in sealing relation thereto. The adapter 20 has a forward extension portion 22 which is threaded into an interior rearwardly opening cavity or recess 23 formed in the body 10 which recess opens into the inner group of axial passageways 12. An inner annular seal 24 is received on the extension 22 and forms a seal with the body 10. An outer annular gasket or seal 26 is received on the interface between the body 10 and the adapter 20 and seals on the annular land area defined between the intermediate passageways 15 and the outer passageways 18, and also forms a seal between the outer passageways 18 and the outside of the adapter and body.

The adapter is provided with a plurality of inlets corresponding to the fluids to be applied to the nozzle.

For this purpose, the adapter 10 is provided with a centrally aligned air or gas opening 30 which communicates with a central or axial passageway 32 extending through the extensions 22 and opening into the recess 23. The adapter 20 further includes a second inlet or opening 35 providing means for the application of a first liquid phase to the nozzle. The passageway 35 opens into an annular manifold 36 formed in the adapter 20 in axial and radial alignment with the second set of axial passages 15 between the inner seal 24 and the intermediate seal 26, so that liquid applied to the inlet 35 flows into the annular manifold 36 to the passageways 15.

The adapter 20 further includes a means for applying a second liquid phase to the nozzle in the form of a second liquid inlet 38 which communicates with an outer annular manifold 39 positioned radially outwardly of the manifold 36 and in axial alignment with the outer set of axial passageways 18 in the body 10, through axial openings 39' formed in the gasket or seal 26.

The nozzle of this invention further includes a central axial mandrel or deflector member 40. The deflector member 40 has an inwardly extending hollow stem 42 which is threaded into the body 10. It is further formed with a conically diverging side wall 43 joining with a cylindrical wall portion 44 and terminating in an outwardly and flared portion 45. The interior of the deflector member 40 is hollow at the flared and cylindrical portions to accept an anti-carbon air bleed plug 48. The bleed plug 48 is threaded into the outer open end of the deflector member 40, and may be constructed and operated according to the teachings of the above referenced patent of Cresswell, U.S. Pat. No. 3,923,248. For this purpose, the interior of the plug 48 is formed with an axial passageway 49 communicating with a central opening 50 formed in the member 40 and is further provided with an outer recess 52 opening by reason of a radial connecting passage 53 into the axial passage 49. The head 54 of the plug 48 defines a narrow annular bleed gap or aperture 55 with the outer flat face 56 of the member 40, which gap may be in the order of 0.004 to 0.007 inches. This bleed orifice 55 results in washing the face 56 of the deflector member 40 with a flow of the gas from the inlet 30, and tends to keep the face 56 free of the accumulation of carbon in installations where the nozzle is used as a fuel burning nozzle. Additionally, the bleed orifice 55 tends to keep the face of the deflector member 40 free of accumulation or build up of other solids such as epoxies, paints or the like, where the nozzle is used in other forms of two-part mixing and dispensing.

Figure 2:
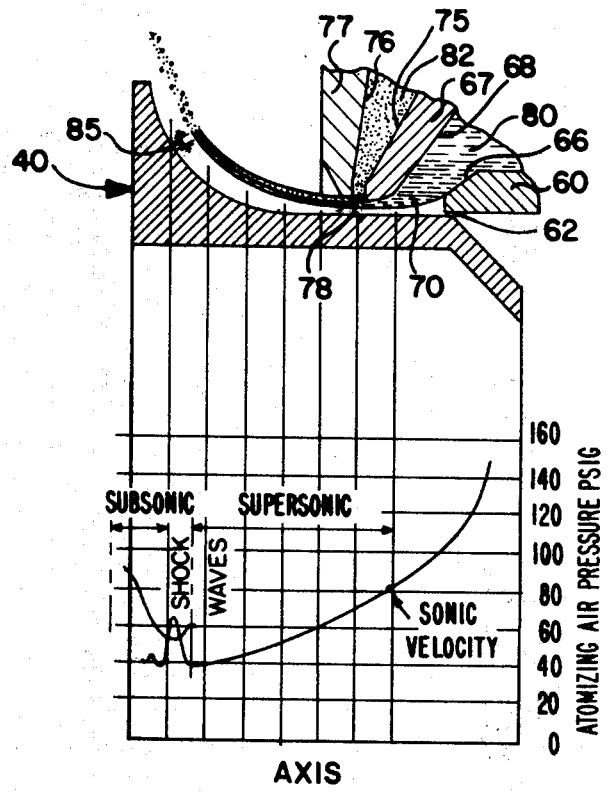
FIG. 2 is a diagrammatic view on an enlarged scale showing the nozzle outlets together with a simplified graphical representation of the gas pressures along the axis of the deflector burning operation.

The forward end of the body 10 is provided with an integral forward extension 60 which has an inner cylindrical surface forming a close clearance fit with the cylindrical portion 44 of the deflector member 40, defining thereby a converging zone between the forward extension 60 and the conical surface 43 and defining an annular gas exit orifice 62 (FIG. 2). The orifice 62 is of controlled dimension so that the gas under pressure from the inlet 30 flows through the first or inner set of passages 12 outwardly and along the underlying cylindrical surface 44 of the deflector member 40.

The body 10 further supports an inner cap nut or shell 65 which is threaded onto the body 10 at 66 outwardly of the second set of passageways 15. The shell 65 has an inner surface which forms a clearance with the outer surface of the forward extension 60. The forward extension 60 is formed with a frustoconical face 66, and the forward nose portion 67 of the nut or shell 65 is also formed with an inner conical face 68 forming a converging nozzle orifice 70 (FIG. 2) which opens at the deflector member 40 immediately forward of the gas orifice 62 defined by the extension 60, so that a metered or controlled layer of first liquid from the inlet 35 is applied in superimposed relation to the gaseous layer from the nozzle 62.

A second or outer cap nut or shell 72 is threaded onto the exterior of the body 10 at 73 and defines an annular clearance space with the inner shell 65. The inner shell 65, at its forward or nose portion 67 is formed with an outer tapered conical surface 75 which cooperates with an inner conical surface 76 formed in the nose 77 of the shell 72 to form a second liquid nozzle orifice 78 which opens at the deflector member 40 immediately forward of the first liquid nozzle orifice 70. The second liquid applied through the inlet 38 communicates with the annular space defined between the inner and outer shells through the outer array of passageways 18 so that a second metered liquid phase is applied by the orifice 78 as a sheath in superimposed relation to the first liquid phase applied by the nozzle orifice 70.

The operation of the invention may be evident by reference to the diagram of FIG. 2 which shows a fragment of the respective nozzles in enlarged detail, and includes a diagram of air pressure along the axis of the deflector member 40. In FIG. 2 the first phase liquid is illustrated at 80 and the second phase is illustrated at 82 as being applied by the respective annular nozzles in superimposed relation immediately forward of the gas nozzle 62. The compressed air, steam, or other gas is delivered from the inlet 30 or axial passage 32 into the passageways 12 and through the annular nozzle 62 defined between the nose portion 60 and the cylindrical portion of the deflector member 40 a a subsonic velocity in underlying relation to the outer annular liquid sheaths applied by the respective cap nuts or shells 65 and 72. The compressed air expands during this stage and forces the liquids away from the surface of the deflector member 40 forming an effective divergent nozzle between the spray deflector 40 and the liquid films. Supersonic velocities are attained by reason of the expansions and the energy is transmitted in part to the superimposed films inducing shear and causing the films to be accelerated, to be reduced in thickness, and broken up as a spray. The transition from supersonic to subsonic creates shock waves at the region indicated approximately at 85 in FIG. 2, resulting in violent pressure fluctuations. The shock waves vibrate the liquid layers causing further shearing, intermixing, and break up or atomization of the particles in a plane perpendicular to the horizontal shearing direction. Intermixing of the two parts or the liquid phases 80 and 82 takes place at a region exteriorly of the nozzle at the diverging or curved portion 45 of the deflector member 40. The air cushion between the spray and the deflector prevents re-entrainment of the droplets or wetting of the surfaces of the deflector member 40.

The invention is not limited to the employment of two shells and it is thus within the scope of the invention to apply a third shell where desirable to apply a third liquid to be intermixed and atomized with the liquid phases 80 and 82.

The diverging or curved portion 45 may be selected so as to achieve the desired spray pattern and distribution. If desired, the curvature may be reduced or eliminated so as to control the angle of divergence from the nozzle.

While the form of apparatus herein described constitutes a preferred embodiment of this invention, it is to be understood that the invention is not limited to this precise form of apparatus, and that changes may be made therein without departing from the scope of the invention.

What is claimed is:

1. A mixing nozzle comprising:

a body having means defining a first orifice for directing a thin film of gas outwardly therefrom at supersonic speed for subsequent transition to subsonic speed at a region outwardly of said orifice, means in said body defining a second orifice position immediately outwardly of said first orifice for applying a thin film of a first liquid in superimposed relation to said gas at said supersonic region, and means in said body defining a third orifice immediately outwardly of said second orifice for applying a thin film of a second liquid in superimposition to said first liquid film at said supersonic region.

2. The nozzle of claim 1 further including means in said body defining a deflector member positioned in underlying relation to said orifices for directing the flow of said gas from said first orifice and extending outwardly of said second and third orifices for confining the flow of said gas from the supersonic region to the subsonic region.

3. A multiple part spray nozzle comprising;

a body having at least three sets of axially extending arcuately spaced discrete passageways therethrough, including an inner set of passageways, an intermediate set of passageways, and an outer set of passageways, means for applying a gas under pressure to said inner set of passageways, and means for applying separate liquids under pressure, respectively, to said intermediate and outer passageways, means on said body defining a forwardly extending mandrel having an outer generally cylindrical surface terminating in an outwardly flared surface, extension means on said body defining with said cylindrical surface a first orifice communicating with said inner set of passageways for applying a film of air under pressure at said mandrel cylindrical surface for acceleration by expansion to a supersonic speed, a first nut on said body outwardly of said second set of passageways and defining a space with said body extension means and having a nose portion defining with said mandrel a second orifice immediately adjacent said first orifice for applying liquid from said second set of passageways in superimposition, and a second nut on said body outwardly of said first nut and defining between said first and second nuts a space communicating with said third set of passageways, said second nut having a nose portion defining a third orifice at said mandrel cylindrical portion immediately adjacent said second orifice for applying a second layer of liquid in superimposition onto said first layer, whereby the gas flow from said first orifice causes acceleration and thinning of the flow of liquids from said second and third orifices along said cylindrical portion and a shock wave is created at said curved portion of said mandrel for intimately intermixing and dispersing said first and second liquids.

* * * * *